United States Patent [19]

Hamel

[11] 4,100,727

[45] Jul. 18, 1978

[54] METHOD OF MAKING A CORE YARN

[75] Inventor: Edmund Hamel, Romanshorn, Switzerland

[73] Assignee: OFA AG, Horn, Switzerland

[21] Appl. No.: 790,088

[22] Filed: Apr. 22, 1977

[30] Foreign Application Priority Data

Oct. 6, 1976 [DE] Fed. Rep. of Germany ..... 2645119

[51] Int. Cl.[2] ..... D02G 3/38

[52] U.S. Cl. ..... 57/160; 57/144

[58] Field of Search ..... 57/12, 144, 152, 160, 57/163

[56] References Cited

U.S. PATENT DOCUMENTS

| | | | |
|---|---|---|---|
| 2,990,673 | 7/1961 | Adkins, Jr. | 57/160 X |
| 3,092,953 | 6/1963 | Blackstock | 57/160 X |
| 3,164,951 | 1/1965 | Donaldson et al. | 57/160 |
| 3,264,816 | 8/1966 | Jaggi | 57/160 |
| 3,596,459 | 8/1971 | Wada et al. | 57/160 |

*Primary Examiner*—Richard C. Queisser
*Assistant Examiner*—Charles Gorenstein
*Attorney, Agent, or Firm*—Karl F. Ross

[57] ABSTRACT

A method of making a core yarn in which a pair of flattened slubbings or fiber-fleece strips are passed through a stretching arrangement comprising a plurality of pairs of rollers, the slubbing being engaged in the nips of the rollers, with the core thread being fed to each of the slubbing strips in the nip of the last roller pair. According to the invention, the two slubbing strips are passed directly adjacent one another (either in contact or with a small spacing) through the nip of the last roller pair and immediately downstream thereof, the combination of strips and the respective core threads are spun together.

11 Claims, 5 Drawing Figures

10

14
16
12
STRETCHING
20
a
18
13
b
c
S
II
22
CORE YARN
RING
SPINDLE
TWISTING
24

Fig. 2
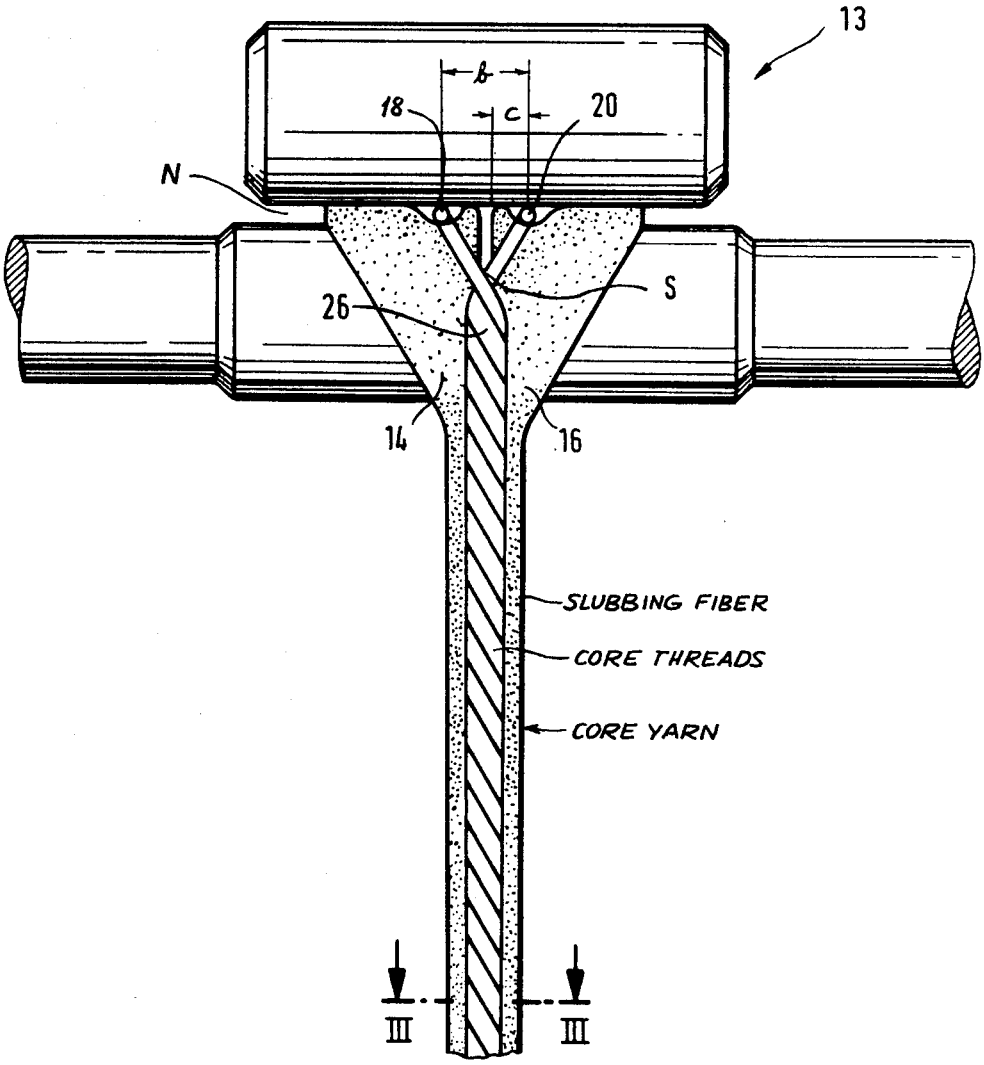
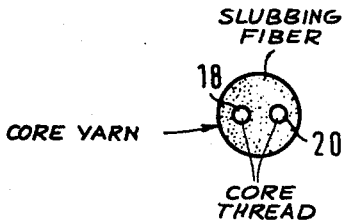
Fig. 3

METHOD OF MAKING A CORE YARN

FIELD OF THE INVENTION

The present invention relates to a method of producing a core yarn and, more particularly, to a process for producing a core yarn of the type in which core threads are received within and surrounded by a fiber-fleece material which originally is in the form of at least one slubbing strip.

BACKGROUND OF THE INVENTION

It is known to stretch a fiber-fleece slubbing strip in a stretching arrangement comprising a plurality of roller pairs which engage the strip of the fiber-fleece slubbing within the nip of each roller pair. Two such slubbings can be provided, each being twisted together with a core thread and the composites (each of a slubbing strip and core thread) being twisted together in a ring spindle, flyer spindle or like spinning or twisting arrangement.

The resulting core yarn thus has at least two core threads disposed generally within a body of the fiber-fleece material which originally formed the slubbings. A fiber-fleece slubbing comprises, according to the invention and the prior art, a strip of intertwined but nonwoven fibers which are held together by mutual frictional contact. The core yarn can be a continuous monofilament or a thread made from a plurality of monofilaments. An advantage of a core yarn fabricated in the manner described is that it can have an external characteristic similar to that of the natural fiber from which the slubbing is constituted while possessing a strength equal to or greater than that of the monofilaments forming the core threads.

A process in which a core yarn is formed in the manner described above is known from Swiss Pat. No. 395,819 (U.S. Pat. No. 3,264,816). In this prior art process, the rollers of the last pair as well as the rollers upstream therefrom have large lengths (cf. page 2, right hand column, lines 98 and 99) to permit the fiber-fleece strips or slubbings to be separated from one another by large distances. A respective core thread is then led to each of the strips at the last roller pair of the stretching device. Each strip and the associated thread are then twisted together. Later, the combinations, each of a strip and core thread, together are passed through a thread guide in an axial extension of a ring spindle to twist them together. Hence the vertex of the twisting triangle lies at this thread guide.

While the conventional process gives a high resistance to sliding movement of the fiber-fleece material along the core threads, it has been found that this sliding resistance stability against relative longitudinal shifting of the fiber-fleece strip and the core thread is not fully satisfactory.

OBJECT OF THE INVENTION

It is the principal object of the present invention, therefore, to improve upon the aforedescribed process and thereby increase the sliding resistance of the fiber-fleece material along the core threads.

SUMMARY OF THE INVENTION

Surprisingly, it has now been found that it is possible to increase the sliding resistance of the slubbing material with respect to the core threads by a relatively simple procedure which involves feeding the slubbing strips to the last roller pair directly adjacent one another (i.e. with their proximal edges in direct contact, slightly overlapping or with a minimum spacing from one another), and then twisting the entire assembly of the two slubbing strips and the respective core threads which have been fed to each of the slubbing strips in the nip of the last roller pair in a ring spindle or a flyer spindle. In this manner, the twisting point is found to lie directly adjacent the last roller pair and the resulting product has a markedly improved sliding resistance.

When the two fiber-fleece slubbing strips are described as lying directly adjacent one another in the last roller pair of the stretching apparatus, it is intended to indicate thereby that the two fiber-fleece strips are either in lateral contact with one another or are spaced apart by a minimum spacing, the core threads being fed to the respective slubbing strips in the region of the contact line between them or the gap which is provided between the slubbing strips at the last rollers of the stretching device. The size of the gap between the slubbing strips is a function of the yarn number and fiber type of the material to be spun and the nature of the contact between the two strips and the character of the fibers which project therefrom. In practice it has been found that the gap between the slubbing strips must be smaller than 2 mm and is preferably smaller than 1 mm with still better results being obtained when this gap is smaller than 0.5 mm. Effective results are obtained when the gap is equal to the thickness of the slubbing strip.

The core threads can be any commercial endless filament thread and can be a monofilament or a thread composed of a large number of endless fibers or monofilaments, depending upon the desired fineness of the corn yarn to be produced. When a multiplicity or plurality of filaments constitutes the core thread, it is desirable that the filaments of each core thread be held together by a light protective twist.

The core thread can be a textured thread, a thread of pure silk, a staple-fiber yarn or twine, depending upon the ultimate purpose of the core yarn.

The yarn thickness, of course, depends upon the ultimate use and can be established by appropriate choice of the yarn or twine number in accordance with the end product. Fine core yarns can be used for sewing threads while coarse yarns can be used for nonwoven fiber webs, for example, for paper machines.

The endless filament threads are preferably composed of synthetics such as nylon, purlon, polyamide and polyesters.

The endless filament threads can be smooth-surfaced or curled, e.g. by subjecting them to a high twist and thermal fixation in the high twisted state.

The fiber-fleece (slubbing) strips are, according to the invention, flattened or rolled to a relatively wide state in the stretching apparatus. The width of these strips is determined by the fineness of the roving which is flattened to form this slubbing strip and this, in turn, is dependent upon the fineness of the fibers constituting same.

The core threads are preferably fed to the fiber-fleece slubbing strips in such manner that their distance from the respective aforementioned proximal edge is substantially smaller than the total width of the fiber-fleece slubbing strip. Preferably, the core threads are each fed to the respective slubbing strip at a distance from the edge thereof which is proximal to the other slubbing strip which is less than half, preferably less than one fifth, of the total width of the fiber-fleece slubbing strip. Best results are obtained when this distance is less than one tenth the total width of the slubbing strip. In absolute perameters, it has been found that the core thread should be deposited upon the fiber-fleece slubbing strip at a distance from the edge thereof proximal to the edge of the other slubbing strip which is less than 2 mm, preferably less than 1 mm. Best results are obtained when this distance is smaller than 0.5 mm.

In a preferred embodiment of the invention, only a single core thread is fed to each of the slubbing strips.

Advantageously, the fiber-fleece slubbing strips are composed of animal or vegetable fibers with different fiber lengths. This permits different core yarn finenesses to be achieved.

According to still another feature of the invention, the tension between the last roll pair of the stretching apparatus and the windup location upon the spool or bobbin of the ring spindle or flyer spindle is taken up by the core threads so that even relatively weak or poorly coherent fiber-fleece slubbings can be used. In this case, of course, the slubbing is not subjected to any significant thread tension. This contrasts with the spinning methods hitherto used. Because the core threads take up substantially all of the tension applied to core yarn during the spinning operation, this tension can be substantially increased corresponding, for example, from a stretch ratio of 1 to 20 to a stretch ratio of about 1 to 40. Hence for yarn of the same quality, the spinning costs can be reduced.

It has been found, most surprisingly, that the process of the present invention, even with a relatively reduced twist to the core yarn, gives a high sliding resistance of the fiber-fleece material with respect to the core threads. The anchoring of the fibers in the resulting core yarn is so good that, at the spinning location, hardly any fibers separate from the slubbing.

BRIEF DESCRIPTION OF THE DRAWING

The above and other objects, features and advantages of the present invention will become more readily apparent from the following description, reference being made to the accompanying drawing in which:

FIG. 2 is a view in the direction of the arrow II in FIG. 1;

FIG. 3 is a section taken along the line III—III of FIG. 2 through the core yarn produced in accordance with the present invention;

SPECIFIC DESCRIPTION

Figures 4, 5:
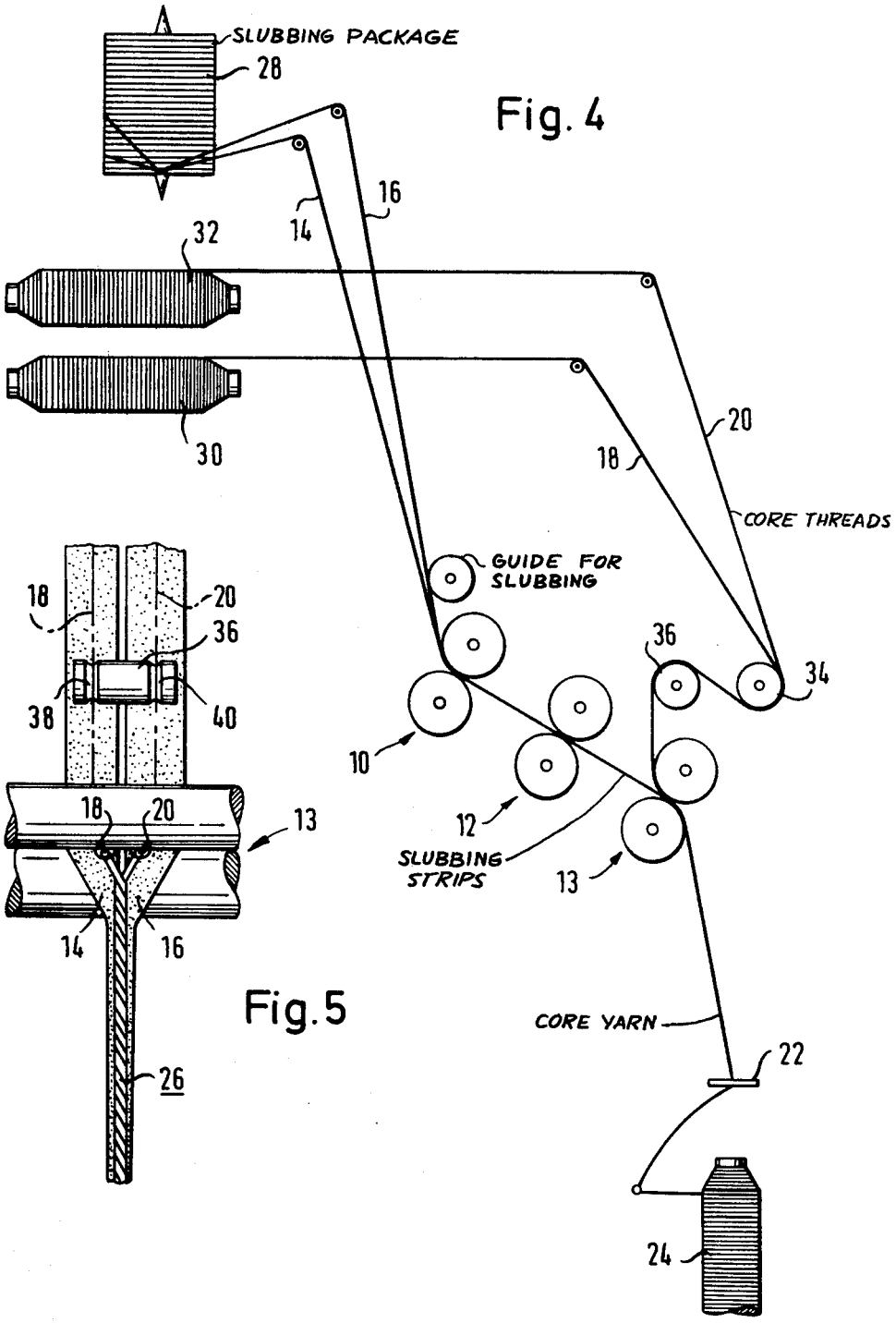
FIG. 4 is a side elevational view, also in diagrammatic form, illustrating the apparatus of FIG. 1.
FIG. 5 is a detail elevational view of the feeding of the core threads to a device of the type illustrated in FIG. 1.

In the drawing, the core yarn has been shown in section in FIGS. 2 and 5, only the twist of the core threads being apparent therein. However, as will be evident from FIG. 1, the entire assembly of core threads and slubbing strips is twisted in practice so that, in a cross section as shown in FIG. 3, the core threads 18 and 20 are fully embedded or encased in the slubbing material.

Figure 1:
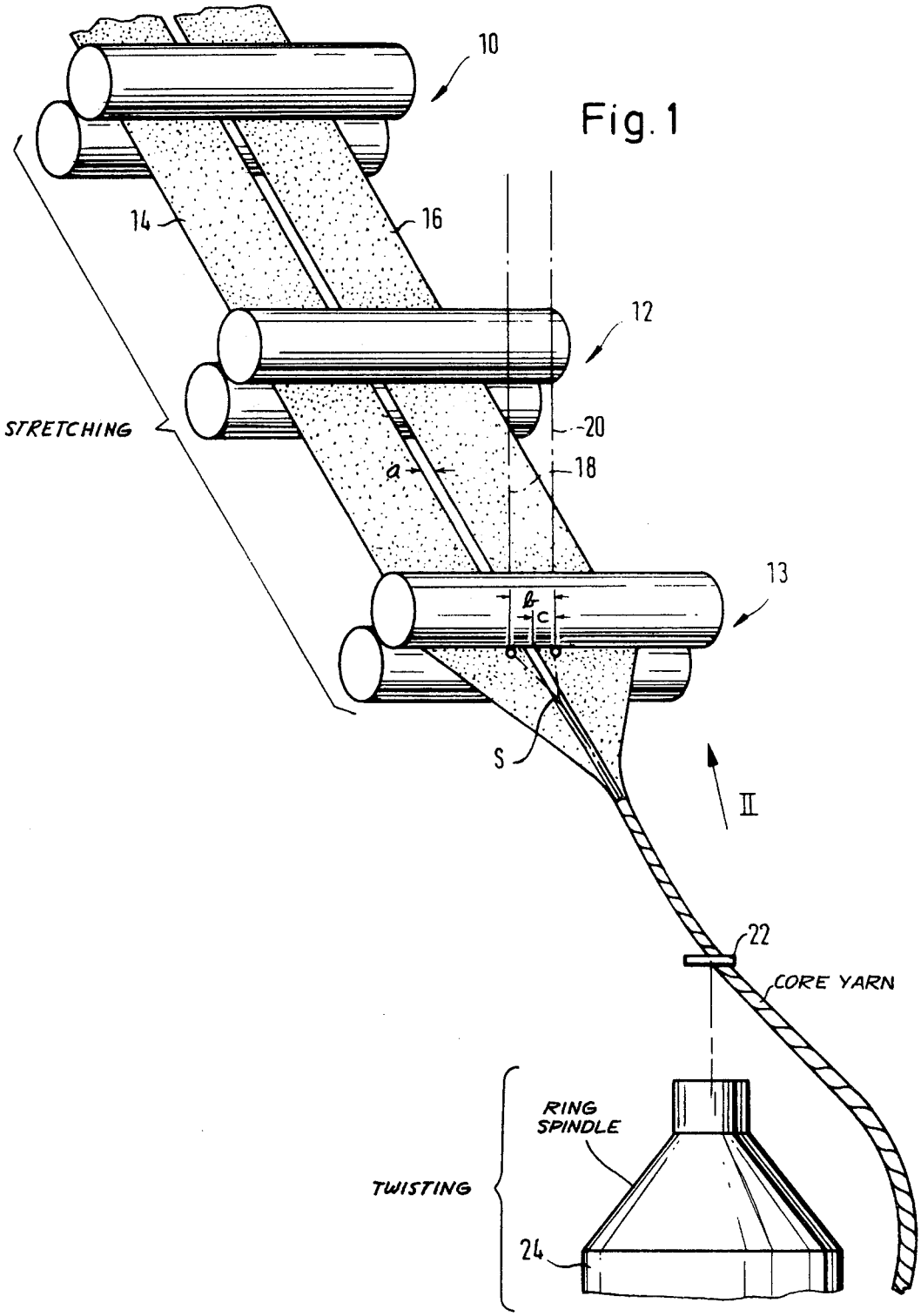
FIG. 1 is a diagrammatic perspective view of a stretching arrangement according to the present invention and illustrating a portion of the ring spindle downstream thereof for twisting the core yarn.

In FIG. 1 there can be seen a stretching device which consists of three roller pairs 10, 12, 13, through the nips of which the slubbing strips 14 and 16 are passed, stretched and flat. A stretching device of this type has been described in Swiss Pat. No. CH-PS 395,819.

The mutually confronting (juxtaposed or proximal) edges of the fiber-fleece slubbing strips 14 and 16 are, shortly before the nip of the last roller pair 13, spaced apart by a relatively small distance *a* which should not exceed 2 mm and preferably is less than 1 mm, even less than 0.5 mm, as described above. Advantageously, this distance *a* is no greater than the thickness to which the slubbing strips are rolled. In fact, although such an arrangement is not illustrated, the proximal edges of the slubbing strips 14 and 15 entering the last pair of rollers 13, can be in contact with one another or even overlap slightly.

In the last stretching roller pair 13, a pair of core threads 18, 20 is introduced, the distance between these core threads being represented at *b* which is only slightly greater than the distance *a*. Thus each of the core threads 18, 20 overlies a respective slubbing strip 14, 16 within the roller pair 13 and has a spacing *c* from the proximal edge of the respective strip which is of the magnitude described previously. The core threads 18, 20, immediately downstream of the roller pair 13, run together in the gap *s* between the slubbing strips.

Downstream of the last roller pair 13 of the stretching device 10, 12, 13, is provided a thread-guide eye 22 which can be axially aligned with a ring spindle 24 on which the core yarn is wound, the ring spindle spinning the assembly of slubbings 14, 16 and core yarns 18, 20 together.

From FIG. 2 it will be immediately apparent that the location S represents the vertex of the spinning triangle formed by the core of the core yarn directly adjacent the nip N of the roller pair 13. The slubbing strips merge together to form the slubbing fiber layer disposed between and around the core threads 18, 20 as shown in FIG. 3. More particularly, the portions of the slubbing disposed laterally of the respective core threads 18, 20 are partially sandwiched between the core threads 18 and 20 and partially wound around them so that the two slubbing strips blend together and completely surrounds the core.

The core yarn of the present invention has been found to have not only a high sliding resistance between the fiber-fleece slubbing material and the core threads, but also an optimum covering of the core threads by the fiber-fleece material.

From FIG. 4 it will be apparent that the two slubbing package 28 in the form of rovings of, for example, wool. These rovings are flattened in the first roller pair 10 of the stretching device. When cotton slubbing is to be used, it is advantageous to provide a separate spool for each of the rovings or slubbing strips of cotton to be fed to the stretching device. The core threads 18 and 20 are drawn from a pair of bobbins 30 and 32 and can pass around a guide roller 34 and over a further roller 36 which can be formed with spaced apart circumferential grooves 38, 40 to properly maintain the gap *b* between the core threads.

If desired, a guide roller pair, also provided with appropriate grooves, can be disposed immediately upstream of the last roller pair 13 of the stretching device to maintain the desired spacing *a* of the slubbing strips 14 and 16.

The core yarns produced by the method of the present invention has been found to be especially advantageous for the production of knitted wear and this is especially the case when the core yarn is of a textured type. In this case, the core threads may be textured or curled threads as described previously. Knitwear produced with a core yarn of the present invention, has a high stretchability, high breaking strength and excellent self-flattening characteristics. Upon washing, the knitted wear has only limited shrinkage and remains substantially wrinkle-free.

EXAMPLE

1. Number of the prepared yarn: 30/1 = 33.33 tex
2. Slubbing material: cotton 17.8 tex (2 slubbings each 8.9 tex) = 54%
3. Core material: 2 Pa. — filament (endless) 15.2 tex = 46%
4. Spin count: 584 t/m
5. Retardation of the fiber-fleece slubbings 40-fold
6. Delivery: 18 m/min (measured at delivery mechanism)
7. Type of stretching mechanism: spinning machine
8. Kind of spindle: ring spindle, flyer spindle, or the like
9. Supply spools: for fiber-fleece slubbing: handing or standing, payoff tangential, for core threads: vertical bobbins, payoff over head
10. Thread brake: disk brake for the core thread filament
11. Polyamide filament threads fed individually over grooved rollers
12. Two rovings for the slubbing strips fed over grooved cylinders.

I claim:

1. A process for producing a core yarn comprising the steps of:

stretching a pair of fiber-fleece slubbing strips in a stretching apparatus having a plurality of roller pairs engaging the slubbing strips in the nips thereof, the slubbing strips emerging from a last roller pair of said apparatus;

maintaining a close spacing of proximal edges of said slubbing strips at least in and through the nip of said last roller pair with said spacing being less than 2 mm;

feeding respective core threads onto said slubbing strips in the nip of said last roller pair with each of the core threads being spaced from the respective proximal edge by a distance less than the width of the respective slubbing strip; and twisting both of said slubbing strips and said core threads together immediately downstream of said last roller pair to form the core yarn.

2. The process defined in claim 1 wherein said proximal edges of said slubbing strips are in contact with one another.

3. The process defined in claim 1 wherein said spacing is less than 1 mm.

4. The process as defined in claim 3 wherein said spacing is less than 0.5 mm.

5. The process defined in claim 1 wherein said core threads are endless-filament threads.

6. The process defined in claim 1 wherein said core threads are fed to said nip of said last roller with a mutual spacing greater than the spacing between said slubbing strips.

7. The process defined in claim 1 wherein each of said core threads is fed to the respective slubbing strip at a distance from the respective proximal edge thereof which is less than 2 mm.

8. The process defined in claim 7 wherein said distance is less than 1 mm.

9. The process defined in claim 8 wherein said distance is less than 0.5 mm.

10. The process defined in claim 4 wherein only a single core thread is fed to each of said slubbing strips.

11. The process defined in claim 10 wherein said core threads are each composed of synthetic-resin filaments and said slubbing strips are composed of natural fibers.

* * * * *